US005079558A

United States Patent [19]

Koike

[11] Patent Number: 5,079,558

[45] Date of Patent: Jan. 7, 1992

[54] EXTENDABLE ANTENNA DEVICE

[75] Inventor: Noboru Koike, Tama, Japan

[73] Assignee: Kabushiki Kaisha Toshiba, Kawasaki, Japan

[21] Appl. No.: 432,842

[22] Filed: Nov. 7, 1989

[30] Foreign Application Priority Data

Nov. 8, 1988 [JP] Japan ..... 63-281647

[51] Int. Cl.[5] ..... H01Q 1/10; H01Q 1/24

[52] U.S. Cl. ..... 343/702; 343/901

[58] Field of Search ..... 343/702, 900, 901, 715, 343/883

[56] References Cited

U.S. PATENT DOCUMENTS 2,491,601 12/1949 Bernstein et al. ..... 343/901

2,735,932 2/1956 Textrom et al. ..... 343/702

4,136,344 1/1979 Nakao et al. ..... 343/702

*Primary Examiner*—Michael C. Wimer

*Attorney, Agent, or Firm*—Finnegan, Henderson, Farabow, Garrett, and Dunner

[57] ABSTRACT

An extendable antenna device which is reducible in length when accommodated and ensures enough elasticity at an area of junction to a housing of a radio device. A first elongated flexible antenna section is connected slidably with a second antenna section. A hold mechanism is provided which holds the first antenna section against the housing of the radio device, and which accommodates and holds the first and second antenna sections in the housing of the radio device.

13 Claims, 6 Drawing Sheets

EXTENDABLE ANTENNA DEVICE

BACKGROUND OF THE INVENTION

1. Field of the Invention

This invention relates to an extendable antenna device suitable for small-sized radio devices such as a portable radio telephone set, which is made elastic at a portion mechanically connected to the radio device so as to prevent breakage of the antenna device, as well as to ensure the safety and the convenience of the users.

2. Description of the Related Art

A variety of studies in miniaturization of radio devices have been made together with the spread of portable telephone sets. In order to achieve such miniaturization, the antenna must be accommodated in the radio device at least when the device is not used. The structure of the antenna today is basically of a $\frac{5}{8}\lambda$-whip type, and has an impedance matching unit built in the device, and antenna elements extended from the transmitter or receiver in use.

FIGS. 9 and 10 show a conventional antenna device which extends its antenna elements in use and accommodate them within the device. In FIGS. 9 and 10, reference numeral 1 denotes a housing of a radio device; 2, a whip antenna; and 3, a printed board.

As shown in FIG. 10, whip antenna 2 includes a body 5, a knob 6 attached to a tip of the antenna body, a stop 7 provided at the base of the antenna body, and a housing junction 8 which attaches antenna 2 to housing 1.

Antenna body 5 is made of a flexible material such as piano wire or wire cable so as to absorb an possible external force applied to the antenna body by bending itself elastically. Antenna body 5 extends through a hole 10 in junction 8. Antenna body 5, base 11 and tip 12 are sized so as to fit into hole 10. Provided on junction 8 is a hollow cylindrical support composed of suspended flexible rectangular tongues 13 which hold base 11 and ensure electrical connection between antenna body 5 and junction 8.

In antenna 2, junction 8 is fixedly screwed into housing 1. Antenna 2 and printed board 3 are electrically connected via a high-frequency connector lead 15.

Since whip antenna 2 is attached to housing 1 in the above arrangement, it is accommodatable into housing 1 when it is not used to thereby facilitate its conveyance. Telephone communication is easily achieved when antenna 2 is extended by pulling the knob 6.

In order to completely accommodate antenna 2 into housing 1 in this radio device, it is necessary to reduce the length of antenna 2 compared with the length of housing 1. If the length of antenna 2 is adjusted to the length of the housing 1 of such a radio device which will be miniaturized every year, antenna 2 would become too short, so that the directionality and gain of the antenna are insufficient and hence the radio performance is deteriorated.

It would be conceivable to use a rod antenna which includes a plurality of extendable cylindrical antenna elements instead of a whip antenna, as disclosed in Published Unexamined Japanese Utility Model Application Sho 56-31056. However, since a rod antenna of this type has insufficient flexibility, a load is likely to be applied to the base of the antenna due to vibrations generated during conveyance or installation of a portable radio device which uses the antenna to thereby cause breakage.

In order to eliminate this drawback, there is a method of providing a coil spring at the base of a rod antenna as shown in Published Unexamined Japanese Utility Model Application Sho 57-12567. However, according to this method, the structure itself is complicated, so that manufacture is difficult, and the device is expensive and likely to be broken. Furthermore, according to the particular embodiment, even if the antenna is accommodated, part of the coil spring extends out of the housing to thereby render it inconvenient to carry the device.

As described above, when the conventional whip antenna device is of the type which is accommodated in the housing of the radio device, it cannot be longer than the length of the housing, and hence it cannot obtain a length satisfying an appropriate wavelength for the device.

If the rod antenna is used instead of the whip antenna, it has inconveniences in that it cannot sufficiently withstand vibrations and shocks.

SUMMARY OF THE INVENTION

It is an object of the present invention to provide an extendable antenna for a radio device which is accommodatable in a housing of the radio device, which is extendable to the length longer than the length of the housing when the antenna is used, which is resistant to vibrations and shocks, and which is easy to manufacture.

According to the present invention, there is provided an extendable antenna device for a radio device comprising: a first flexible rod-like antenna section; a second antenna section slidably connected with the first antenna section; and means for holding the first antenna section and the second antenna section relative to a housing of the radio device.

The first antenna section may be shorter than the length of the housing of the radio device. The second antenna section may be shorter than the length of the first antenna section. The second antenna section may include a hollow cylindrical body which slidably receives the first antenna section therein.

The first antenna section may include one end having an engagement portion which flexibly contacts the internal surface of the second antenna section, and may an another end having a base. The base may be substantially equal in outer diameter to the second antenna section. The antenna holding means may comprise: a housing junction attached to the housing of the communication device and having a hole through which the second antenna section is extendable; and a flexible contact section provided in the housing junction for supporting the base of the first antenna section or the second antenna section in flexible contact relationship thereto. The contact and hold force between the first and second antenna sections through the engagement portion may be set so as to be smaller than the contact and hold between the first antenna section and the flexible contact portion through the flexible contact portion. The second antenna section may include an at least two-stage antenna.

As described above, according to the inventive extendable antenna device, the length of the antenna is sufficiently extendable compared with the housing when it is used. When the extendable antenna device is extended, stresses are likely to collect at a part of the first antenna section which is connected to the housing. According to the present invention, this part of the first antenna section is made flexible, so that it can sufficiently withstand vibrations and shocks. No alleviating spring coils are needed so that the manufacture of the inventive extendable antenna device is easy.

DESCRIPTION OF THE PREFERRED EMBODIMENTS

Figure 1:
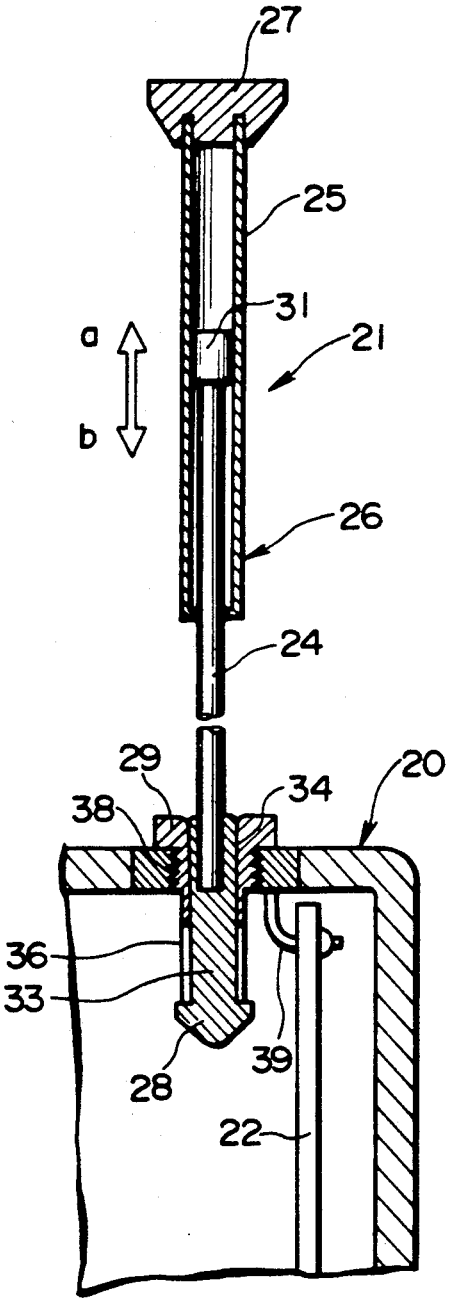
FIG. 1 is a cross section view of the essential portion of one embodiment of an extendable antenna device according to the present invention.
Figure 2:
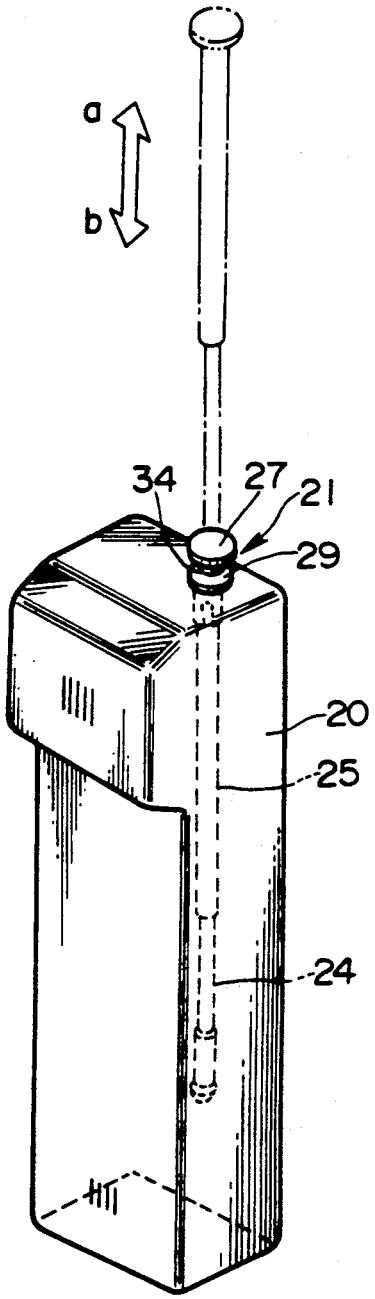
FIG. 2 is a perspective view of a portable radio device having the extendable antenna device of the embodiment.
Figure 5A:
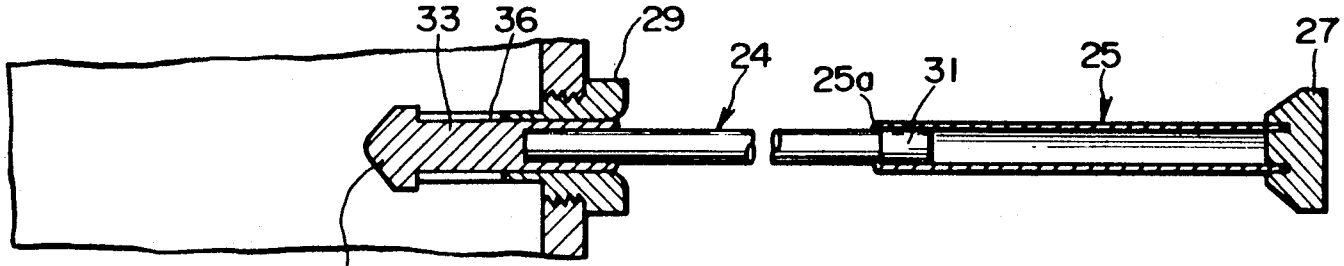
FIGS. 5(*a*), (*b*) and (*c*) are a cross section view of the antenna device and illustrating an extension and retraction of the antenna relative to the radio device.
Figure 5B:
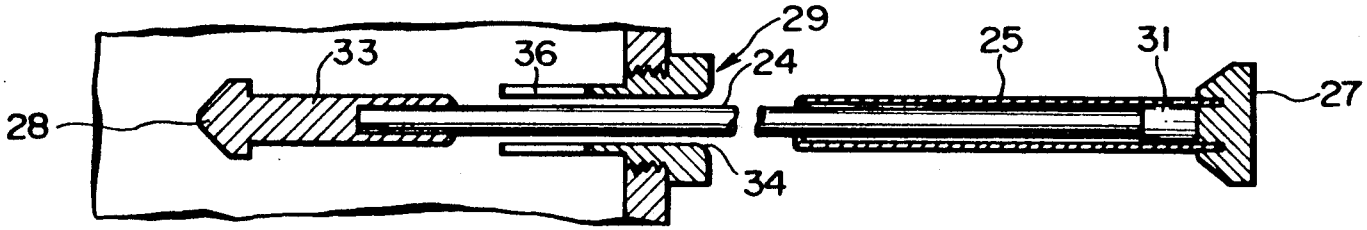
Figure 5C:
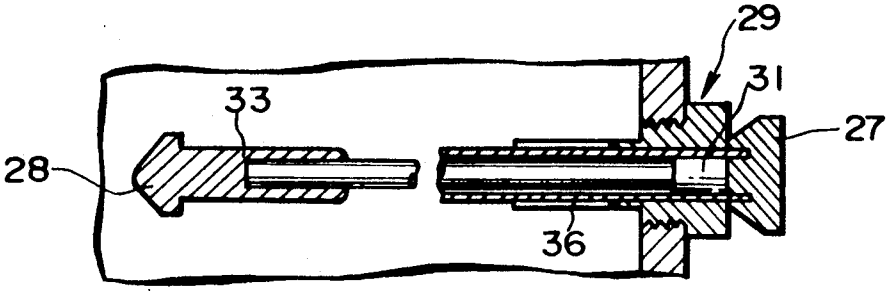

One embodiment of the present invention will now be described in detail with reference to FIGS. 1 and 5. FIG. 2 is a perspective view of a portable radio device with an extendable antenna device according to the present invention. FIG. 1 is a cross section view of the essential portion of FIG. 2.

Figure 3:
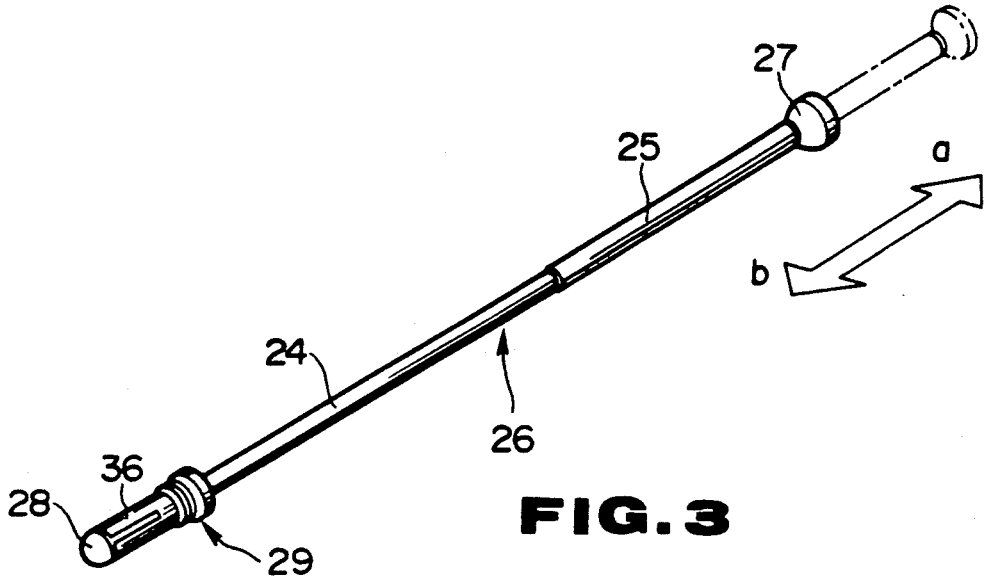
FIG. 3 is a perspective view of the extendable antenna device of the embodiment.

Reference numeral 20 denotes the housing of a radio device; 21, an extendable antenna which is either hollow or solid; and 22, a printed board. As shown in FIG. 3, antenna 21 includes an antenna body 26 which includes a whip antenna section 24 and a hollow cylindrical antenna section 25, a knob 27 attached to an end of cylindrical antenna section 25, a stop 28 provided at the base of the whip antenna section 24 and a housing junction 29 to attach antenna 21 to housing 20.

Figure 4A:
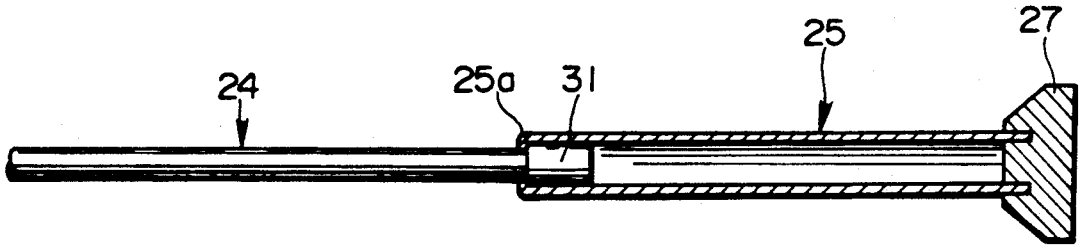
FIGS. 4(*a*) and (*b*) are a cross section view of the extendable antenna device shown in FIG. 3 and illustrating an extension and retraction of the antenna.
Figure 4B:
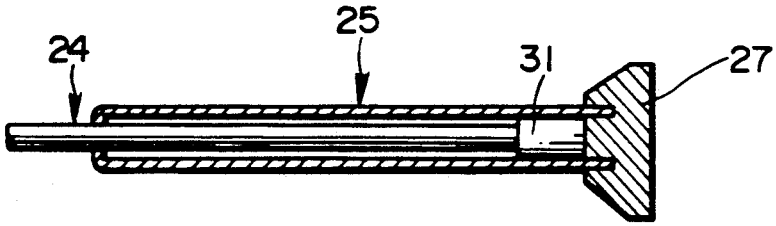

Whip antenna section 24 is made of a flexible core material such as piano wire or wire cable coated with a resin such as polyacetal. As shown in FIG. 4, one end of whip antenna section 24 is inserted in hollow cylindrical antenna section 25 which is held slidable along whip antenna section 24. In that case, as shown in FIG. 1, an elastic engagement portion 31 provided at an end of whip antenna 24 surface contacts the inner wall of cylindrical antenna 25, which is slidable along whip antenna section 24 while keeping electrical connection with whip antenna section 24.

FIG. 4(*a*) shows extendable antenna 21 which is extended to its maximum length in which case cylindrical antenna section 25 is prevented from slipping off from whip antenna section 24 by a reduced end 25*a* of antenna section 25 engaged with the engagement portion 31.

FIG. 4(*b*) shows antenna 21 retracted to its shortest length where whip antenna section 24 is accommodated in cylindrical antenna section 25. Cylindrical antenna section 25 and the base 33 of whip antenna section 24 are the same size in outer diameter.

As shown in FIG. 1, housing junction 29 has a hole 34 through which whip antenna section 24 extends. Hole 34 is sized so as to fittingly receive the base 33 of whip antenna 24 and hollow cylindrical antenna 25. Housing junction 29 has a hollow cylindrical support composed of suspended flexible tongues 36. The outer diameter of antenna section 24 is small compared with the inner diameter of the cylindrical support, the outer diameters of base 33 and cylindrical antenna section 25 are slightly large compared with the cylindrical support. The tongues 36 cooperate to hold the base 33 of whip antenna section 24 at the position of FIG. 1 to ensure electrical connection with housing junction 29. The holding force between whip antenna section 24 and cylindrical antenna section 25 through engagement portion 31 is set so as to be smaller than that between the base 33 of whip antenna section 24 and tongues 36 through the tongues.

As shown in FIG. 1, antenna 21 is attached to housing 20 by screwing housing junction 29 into a female threaded hole 38 provided in housing 20. Antenna 21 is electrically connected via a high-frequency connector lead 39 to printed board 22.

The extension and retraction of the extendable antenna device of this embodiment will now be described with reference to FIGS. 5(*a*), (*b*) and (*c*). FIG. 5(*a*) shows an extended antenna of the antenna device. In this state, the reduced end 25*a* of hollow cylindrical antenna section 25 is engaged with engagement portion 31, the base 33 of whip antenna section 24 is held in flexible contact with hold tongues 36 of housing junction 29, and stop 28 abuts on the end of tongues 36.

Under such condition, if knob 27 of cylindrical antenna section 25 is pressed toward the housing for retraction, whip antenna section 24 is slidably accommodated within cylindrical antenna section 25, the engagement portion 31 of whip antenna section 24 abuts on knob 27 of cylindrical antenna section 25 due to the difference between the holding force between whip and cylindrical antenna sections 24 and 25 via engagement portion 31, and the holding force between base 33 of whip antenna section 24 and tongues 36 via the tongues. This causes the flexible hold between base 33 and tongues 36 to be released, and the antenna section is accommodated within the radio device 20, as shown in FIG. 5(*b*). When hollow cylindrical antenna section 25 arrives at the position of support tongues 36 of housing junction 29, the outer surface of cylindrical antenna section 25 is flexibly held by tongues 36 and knob 27 of antenna section 25 abuts on housing junction 29, whereby the accommodation of the antenna into the housing is completed (FIG. 5(*c*)).

When the antenna is extended, cylindrical antenna section 25 is pulled out, and then the base 33 of whip antenna section 24 is put into contact with and held by tongues 36.

Even when the antenna is accommodated in the radio device 20, cylindrical antenna section 25 is still electrically connected via tongue 36 of housing junction 29 with printed board 22. Therefore, antenna 21 performs its antenna function even when accommodated in the radio device. Thus, an additional built-in antenna and change-over means for switching between the built-in antenna and antenna 21 is unnecessary. According to the present invention, the radio device functions even when antenna 21 is accommodated into the housing.

Extendable antenna 21 is mounted to housing 20 of the radio device in the above arrangement, so that when antenna 21 need not be used, it is retracted in the direction of arrow b so as to be accommodated in housing 1 as shown in FIG. 2. When accommodated in housing 1, antenna 21 does not stick out from housing 20. Therefore, the radio device radio device is easy to carry, and also easy to place in a limited space. Since cylindrical antenna section 25 fits in hole 34 in housing junction 29, antenna 21 will not come out from housing 20 and stick out by vibrations which may occur when it is being carried. By pulling knob 25 in the direction of arrow a (FIG. 1), antenna 21 can be extended to the extent of the sum of the lengths of whip and cylindrical antenna sections 24 and 25, so that the length of antenna 21 can be sufficiently longer than the length of housing 20. Large stresses are likely to apply particularly to the part of whip antenna section 24 connected to housing 20. According to the present invention, this part is made of highly flexible whip antenna section 24. Therefore, even if an external force is applied to antenna 21 when the radio device is being carried or when it is installed, antenna 21 is sufficiently flexible enough to absorb the external force.

Figure 6:
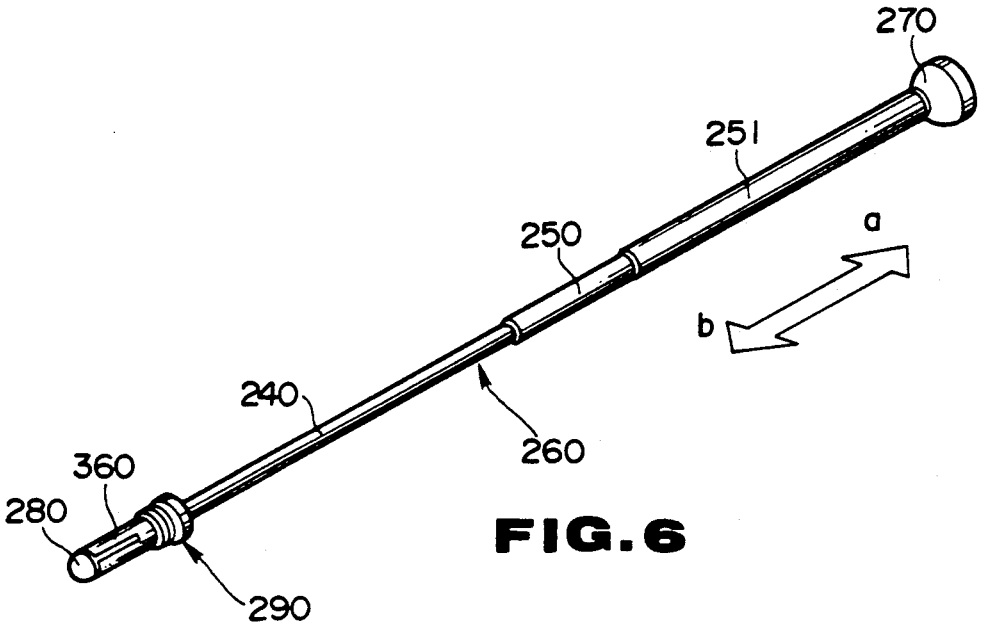
FIG. 6 is a perspective view of another embodiment of the extendable antenna device according to the present invention.

FIG. 6 illustrates another embodiment of the extendable antenna device according to the present invention. In the particular embodiment, a two-stage antenna including hollow cylindrical antenna sections 250 and 251 is connected to whip antenna section 240. Antenna body 260 includes whip antenna section 240 and cylindrical antenna sections 250 and 251. Knob 270 is provided at an end of cylindrical antenna section 251, a stop 280 is provided at the base of whip antenna section 240, and housing junction 290 and tongue 360 are provided.

Figure 7A:
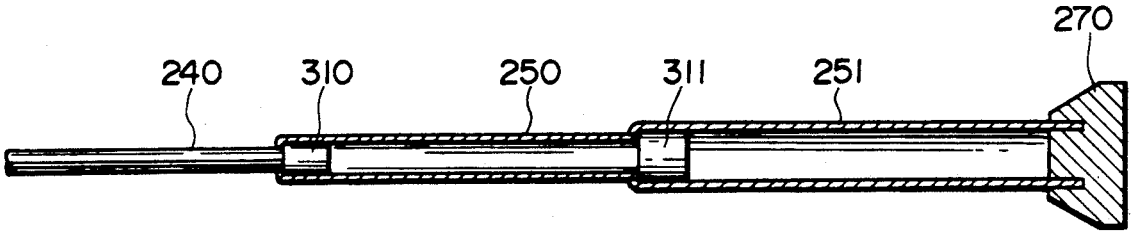
FIGS. 7(*a*) and (*b*) are a cross section view of the antenna device of FIG. 6 and illustrating its extension and retraction.
Figure 7B:
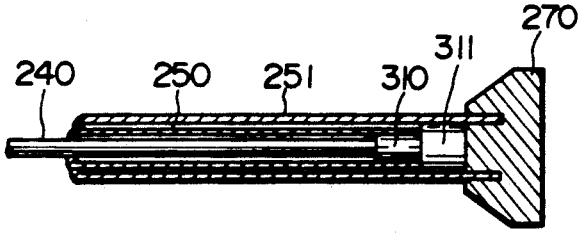

An engagement portion 310 which flexibly contacts the inner surface of hollow cylindrical antenna 250 is provided at an end of whip antenna section 240, as shown in FIG. 7(*a*). A second engagement portion 311 which flexibly contacts the inner surface of hollow cylindrical antenna section 251 is provided at an end of cylindrical antenna section 250. FIG. 7(*a*) illustrates the antenna which is extended to its maximum length.

FIG. 7(*b*) illustrates the antenna which is retracted to its minimum length. In that case, the engagement portion 311 of cylindrical antenna section 250 abuts on knob 270 of hollow cylindrical antenna section 251, and engagement portion 310 of whip antenna section 240 abuts on engagement portion 311 of cylindrical antenna 250. The holding force between the cylindrical antenna sections 250 and 251 through engagement portion 311 is set so as to be smaller than that between whip antenna section 240 and cylindrical antenna section 250 through engagement portion 310 while the holding force between whip antenna section 240 and cylindrical antenna section 250 through engagement portion 310 is set so as to be smaller than that between whip antenna section 240 and tongues 360 through the tongues.

Although the hollow cylindrical antenna section connected to the whip antenna section has been illustrated as having a two-stage structure in the particular embodiment, it may have a three-stage or higher multistage structure.

Figure 8:
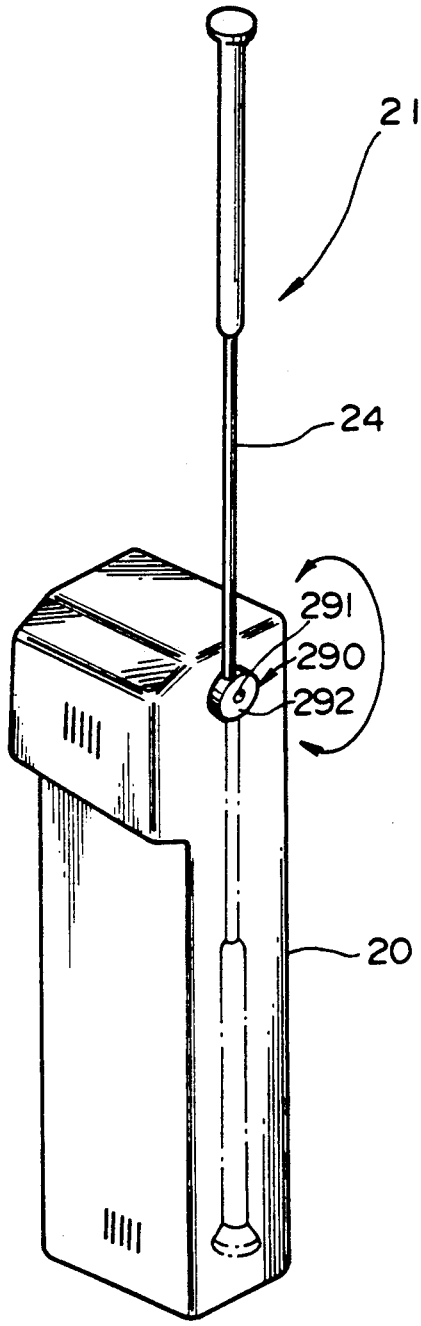
FIG. 8 is a perspective view of still another embodiment of the extendable antenna device according to the present invention.
Figure 9:
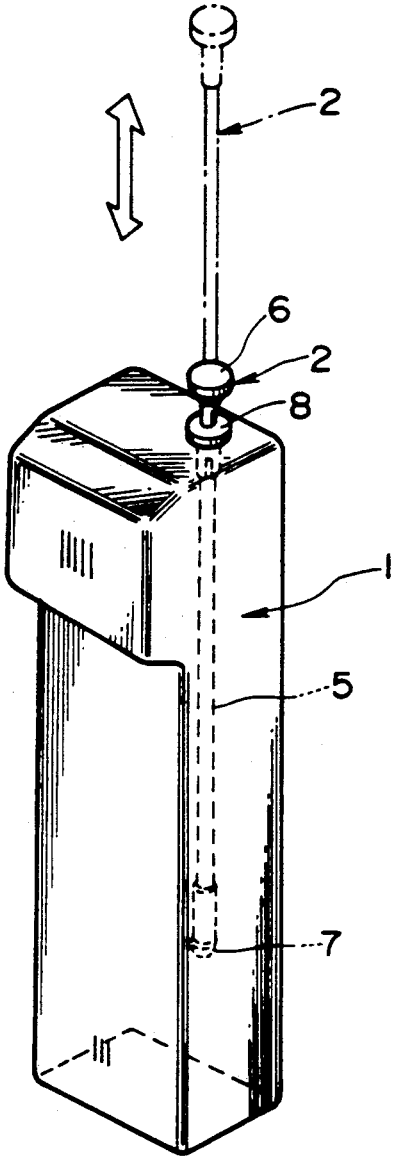
FIG. 9 (PRIOR ART)
FIG. 9 is a perspective view of a conventional portable radio device.
Figure 10:
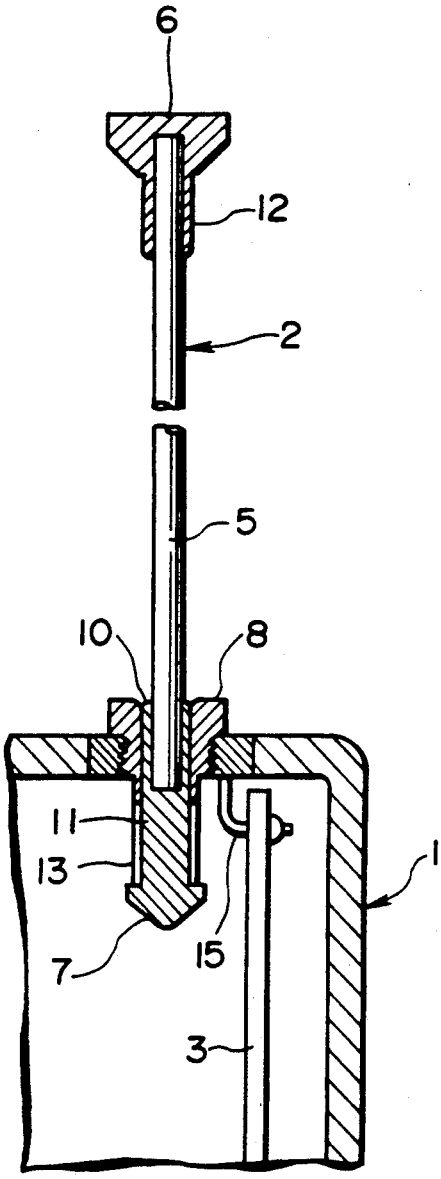
FIG. 10 (PRIOR ART)
FIG. 10 is a cross section view of the essential portion of the conventional antenna device.

Further, in the above embodiments, antenna section 21 is capable of being accommodated into housing 20. However, as shown in FIG. 8, there may be provided a pivot member 290 on a side of housing 20 by means of which antenna section 21 is attached to housing. The pivot member 290 comprises a shaft 291 attached to housing 20 and a ring 292 having a hole through which shaft 291 inserted. Whip antenna section 24 is attached to ring 292. In this embodiment, when the radio device is in operation to communicate with other devices, antenna section 21 is extended to its maximum length and sticked out from the upper side of housing 20 as shown in solid line in FIG. 8. On the other hand, when the radio device is being carried, antenna section 21 is retracted to its minimum length and is rotated to be positioned by a side portion of housing 20 as shown in dash and dotted line.

According to this embodiment, like the above-described embodiments, when the radio device is performing communication, the antenna length can be longer than the length of housing. In addition, since the part of antenna section 21 to which housing 20 of the radio device is connected is made flexible, antenna section 21 can be prevented from damage even when a force is applied. Furthermore, when the radio device is being carried, antenna section 21 is retracted to the length shorter than the length of housing and is rotated to be positioned by a side of housing so as not to stick out from housing 20. Therefore, the radio device according to this embodiment is very convenient to carry like the above-described embodiments.

In this embodiment, antenna section 21 is so designed that it rotates about shaft 291 so as to change its position. However, the present invention is not limited to such design. Any movement of antenna section 21 relative to housing 20 is included in the scope of the present invention as long as such movement enables antenna section 21 to be positioned on the surface of housing 20 when the radio device is being carried.

The extendable antenna device according to the present invention may be not only used in a portable radio device, but also may be used in a wide variety of radio devices including television sets and radio sets.

What is claimed is:

1. An extendable antenna device, comprising:

a first cylindrical antenna section of predetermined length having a hollow circular cross-section with an inner surface and an inside diameter and having two distal ends, one of said distal ends having a reduced inside diameter;

a second cylindrical antenna section of predetermined length, the second section being flexible and having a solid circular cross-section and two distal ends, one of said distal ends being provided with a base portion having substantially the same diameter as the outer diameter of said first antenna section, the other distal end being provided with an engagement portion slidably contacting the inner surface of the first section;

a housing junction mountable to a housing and provided with an opening through which said first antenna section can be inserted and said base portion of said second antenna section is inserted; and a flexible contact portion provided on said base portion of said second antenna section for supporting said base portion of said second antenna section by flexibly contacting said base portion in said opening when said second antenna section is extended from said housing junction, the flexible contact portion adapted to support said first antenna section at its outer surface when said first antenna section is retracted and inserted into said opening of said housing junction.

2. An extendable antenna device according to claim 1, wherein said engagement portion is sized to produce a first holding force between said first antenna section and said second antenna section, and said flexible contact portion includes means for generating a second holding force between said base portion of said second antenna section and said flexible contact portion, said second holding force being greater than said first holding force.

3. An extendable antenna device according to claim 1, further including the housing and wherein said second antenna section is shorter than a length of said housing.

4. An extendable antenna device according to claim 1, further including the housing and wherein said first antenna section is shorter than said second antenna section, and wherein the length of the second section is selected so that both said first and second sections can be accommodated together in said housing.

5. An extendable antenna device according to claim 1, further comprising an additional antenna section in slidable connection to said first antenna section.

6. An extendable antenna device according to claim 1, further including the housing and wherein the length of said second antenna section is chosen such that when the first section is accommodated in the housing it completely receives and covers the second section.

7. An extendable antenna device according to claim 1, further including the housing, wherein said housing is a housing of a portable radio device.

8. An extendable antenna device, comprising:

a first cylindrical antenna section of predetermined length having a hollow circular cross-section with an inner surface and an inside diameter and having two distal ends, one of said distal ends having a first reduced inside diameter;

a second cylindrical antenna section having a hollow circular cross-section with an inner surface and an inside diameter and having two distal ends, one of said distal ends being provided with a first engagement portion slidably contacting the inner surface of said first antenna section, the other distal end having a second reduced inside diameter;

a third flexible antenna section having a solid circular cross-section and two distal ends, one of said distal ends being provided with a base portion of substantially the same diameter as the outer diameter of the first antenna section, the other distal end being provided with a second engagement portion slidably contacting the inner surface of said second antenna section;

a housing junction mountable to a housing and provided with an opening through which said first antenna section can be inserted and said base portion of said third antenna section is inserted; and a flexible contact portion provided on said base portion of said third antenna section for supporting said base portion of said third antenna section by flexibly contacting said base portion in said opening when said third antenna section is extended from said housing junction, said flexible contact portion adapted to support said first antenna section at its outer surface by flexibly contacting said outer surface when said first antenna section is retracted and inserted into said opening of said housing junction.

9. An extendable antenna device according to claim 8, wherein said first engagement portion is sized to produce a first holding force between said first antenna section and said second antenna section, said second engagement portion is sized to produce a second holding force between said second antenna section and said third antenna section, and said flexible contact portion includes means for generating a third holding force between said base portion of said third antenna section and said flexible contact portion, said first holding force being smaller than said second holding force and said second holding force being smaller than said third holding force.

10. An extendable antenna device according to claim 8, further including the housing and wherein said third antenna section is shorter than a length of said housing.

11. An extendable antenna device according to claim 8, further including the housing and wherein said second antenna section is shorter than said third antenna section and said first antenna section is shorter than or equal to the length of said second antenna section.

12. An extendable antenna device, comprising:

a first cylindrical antenna section having a hollow circular cross-section with an inner surface and an inside diameter and having two distal ends, one of said distal ends having a reduced inside diameter; and a second flexible antenna section having a solid circular cross-section and two distal ends, one of said distal ends being provided with mounting means for rotatably mounting said second flexible antenna section onto a housing, the other distal end being provided with an engagement portion slidably contacting with said first antenna section at its inner surface.

13. An extendable antenna device, comprising:

a first cylindrical antenna section having a hollow circular cross-section with an inner surface and an inside diameter and having two distal ends, one of said distal ends having a reduced inside diameter;

a second flexible antenna section having a solid circular cross-section and two distal ends, one of said distal ends being provided with a base portion of substantially the same diameter as the outer diameter of said first antenna section, the other distal end being provided with an engagement portion slidably contacting said first antenna section at its inner surface;

a housing junction mounted to a housing of a radio device and provided with an opening through which said first antenna section may be inserted and said base portion of said second antenna section is inserted;

a flexible contact portion provided on said base portion of said second antenna section for supporting said base portion of said second antenna section by flexibly contacting said base portion in said opening when said second antenna section is extended from said housing junction, said opening adapted to support said first antenna section at its outer diameter by flexible contact when said first antenna section is retracted and inserted into said opening of said housing junction; and connecting means provided on said housing junction for electrically connecting said second antenna section with an electric circuit of said radio device.

* * * * *

UNITED STATES PATENT AND TRADEMARK OFFICE

CERTIFICATE OF CORRECTION

PATENT NO. : 5,079,558

DATED : January 07, 1992

INVENTOR(S) : Noboru Koike

It is certified that error appears in the above-identified patent and that said Letters Patent is hereby corrected as shown below:

Claim 13, column 8, line 60, change "opening" to --flexible contact portion--.

Claim 13, column 8, line 61-62, change "diameter" to --surface--.

Signed and Sealed this

Seventeenth Day of August, 1993

Bruce Lehman

*Attest:*

BRUCE LEHMAN

*Attesting Officer*

*Commissioner of Patents and Trademarks*